US005243714A

United States Patent [19]

Osmond

[11] Patent Number: 5,243,714

[45] Date of Patent: Sep. 14, 1993

[54] PRIMER ACTIVATED SYPHON FLUSHER FOR TOILETS

[76] Inventor: John S. Osmond, 731 Cedar St., Santa Monica, Calif. 90405

[21] Appl. No.: 951,837

[22] Filed: Sep. 28, 1992

Related U.S. Application Data

[63] Continuation-in-part of Ser. No. 695,402, May 3, 1991.

[51] Int. Cl.[5] ..... E03D 1/06

[52] U.S. Cl. ..... 4/370

[58] Field of Search ..... 4/368-370, 4/374, 376, 377

[56] References Cited

U.S. PATENT DOCUMENTS

| | | | |
|---|---|---|---|
| 529,584 | 11/1894 | Booth | 4/368 |
| 1,562,585 | 11/1925 | Phillips | 4/370 |
| 3,973,751 | 8/1976 | Brugnolic et al. | 4/368 X |

FOREIGN PATENT DOCUMENTS

| | | | |
|---|---|---|---|
| 0029500 | 8/1907 | Austria | 4/377 |
| 0017666 | 11/1889 | United Kingdom | 4/376 |
| 0012717 | 5/1893 | United Kingdom | 4/376 |
| 0003023 | 2/1894 | United Kingdom | 4/376 |

*Primary Examiner*—Charles E. Phillips
*Attorney, Agent, or Firm*—William H. Maxwell

[57] ABSTRACT

A toilet flushing apparatus characterized by an inherently leakproof syphon discharge through a toilet flush tube, characterized by a pre-primed syphon wherein both the suction leg and the discharge leg are filled with supply and primer tank water, and with a floating flush valve for complete discharge of primer tank water to initiate syphoning, the primer tank being automatically refilled with the rise of float controlled supply tank water, only one primer tank-full of water may be lost.

12 Claims, 3 Drawing Sheets

PRIMER ACTIVATED SYPHON FLUSHER FOR TOILETS

Reference is made to Disclosure Document No. 267780 entitled PRIMER JET TOILET FLUSHER, filed in the U.S. Patent & Trademark Office Nov. 20, 1990, this application being a continuation in part of my application Ser. No. 07/695,402 filed May 3, 1991.

BACKGROUND OF THE INVENTION

A common flushing apparatus for toilets involves a reseating flush valve that holds a large volume of supply water in a tank from which it is suddenly released into the toilet bowl. And, a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in continued water waste.

Another flushing apparatus, common in the United Kingdom, involves a syphon tube having its suction leg depending into the supply tank so as to be filled with water, and its discharge leg normally empty of water and opening into the toilet bowl, and operated by means of a primer pump that is manually actuated to fill the discharge leg thereby initiating syphoning. The said primer pump operates as a water lifting means in the suction leg of the syphon, and the advantage of this syphon system is that there can be no leakage from the supply tank through the inactive syphon. However, the pump means gradually deteriorates and requires repeated cycles of operation in order to complete a flushing of the toilet, and eventually becomes inoperative.

In view of the foregoing, it is an object of this invention to employ the aforesaid syphon tube flush principle of operation to the exclusion of pump means, and replacing the aforesaid pump-type primer means with a syphon primer means activated by opening of the flush valve, all in combination with an otherwise conventional toilet.

The syphon principle of operation is superior with respect to the conservation of water, in that there can be no continuous leakage therethrough when its discharge leg is empty of water. And, only when the discharge leg is primed does water flow therethrough. On the contrary, the conventional flush valve principle of operation is prone to continuous leakage from the water supply tank and through the flush tube, due to deterioration of either the valve seat or valve ball. It becomes apparent therefore that the syphon principle is superior, except for the inevitable deterioration of the United Kingdom type pump means thereof which typically deteriorates and requires repeated cycles of operation in order to complete a flushing of the toilet, and inevitably becomes inoperative.

In view of the foregoing, it is an object of this invention to employ the aforesaid syphon tube flush principle of operation to the exclusion of a pump means, and replacing the aforesaid pump-type primer means with a pre-primer means operable by opening the flush valve, and all in combination with an otherwise conventional toilet.

It becomes apparent therefore that the United Kingdom syphon principle is superior, except for the inevitable deterioration of the pump means thereof which is typically a flap or disc of flexible material that lifts the tank water into the syphon and initiates continued flow therethrough until the water supply tank is emptied through the flush tube. Accordingly, these two widely used principles of operation are each subject to deficiencies, one to inherent leakage and the other to eventual inoperation. In view of the foregoing, it is an object of this invention to provide a toilet flushing apparatus that virtually eliminates leakage of the flush water, and that provides automatic refilling of a primer tank for repeated flushings.

It is to be understood that the water supply tank is refilled after each flushing operation, or incomplete flushing operation, by means of a conventional and accepted water level responsive valve means from a water supply service pipe. In practice, a float controlled valve returns the tank water level to the bridge of the syphon after each flushing operation, complete or incomplete. And, it is this maintained water level that automatically refills the primer tank.

The syphon principle of operation is characterized by two conditions, a passive condition wherein the discharge leg is closed to the flush pipe by the flush valve and the primer tank is in open communication with and to fill the discharge leg with water up to the syphon bridge coincidental with the supply tank water level and with a transfer passage over the bridge and between the two syphon legs being empty and vented to atmosphere, and a functioning condition wherein the discharge leg is opened to the flush pipe by lifting the flush valve, a float, and opening the primer tank for discharge of its primer water over a jet opening of the discharge leg and into the flush pipe and inherently closing the atmosphere vent to said transfer chamber.

The flush valve closes the discharge leg below the bottom opening of the primer tank, the bottoms of the primer tank and discharge leg being separated by the jet opening and in open communication. In order to achieve said functioning condition, priming of the syphon is required for filling the otherwise empty transfer passage with water, whereupon syphoning action is initiated and continues to occur. It is an object of this invention to initiate syphoning by pre-priming the transfer passage with a small volume of water through the suction leg of the syphon and thereby initiate the syphon effect. That is, by flooding the two syphon legs and thereby enabling the syphon function.

The apparatus herein disclosed is characterized by a manually activated primer means in the form of a primer tank that dumps water over a jet opening and into the flush tube, and which simultaneously draws water over the syphon bridge for priming the syphon. The atmospheric closure of the transfer passage in the flush mode is a prerequisite to successful flushing, and to this end it is an object of this invention to provide vent control means by which the transfer passage is closed to atmosphere in the flush mode, said vent being open to atmosphere in the passive mode in order to enable filling of the two syphon legs.

In the preferred embodiment of this invention, the flush valve is positioned at the bottom of the syphon discharge leg in open communication with both the discharge leg and primer tank water, both legs of the syphon being primed when the storage tank water level is automatically replenished. In practice, operation is restored by simply re-filling the primer tank, and repair is by cleaning or replacement of the valve seat or flush valve. Accordingly, it is an object of this invention to prevent closure of the syphon when the primer tank water is depleted, and to this ends means is provided to ensure flotation of the flush valve during flow of water from the bottom of the syphon discharge leg, all of which is accomplished by upward reaction of water thrust against the flush valve, as will be described.

SUMMARY OF THE INVENTION

This invention relates to water closets or toilets and particularly to the flushing apparatus therefor by which defication and urination etc. is disposed of as sewage. Heretofore, substantial quantities of water have been wasted by flushing apparatus employed, as by inherent leakage and by mechanical deterioration resulting in malfunction and/or insufficient operation requiring repeated flushing attempts. The flush valve type of apparatus that is manually activated to open the conventional flush tube is subject to continuous leakage and waste of water, while the non-leak syphon type apparatus inevitably deteriorates mechanically and eventually becomes inoperative. However, it is an object of and this invention combines the advantages of the non-leak syphon type apparatus with a primer means, whereby the pump means is eliminated and the controlling flush valve is subject only to a small amount of leakage from the primer tank only.

The toilet flushing apparatus herein disclosed is primer tank activated, simply by flooding the flush pipe with water at velocity from a syphon discharge tube in order to initiate syhoning that depletes the water supply tank during each flushing operation. Accordingly, this invention is characterized by a syphon discharge and a flush tube, and by a rechargeable primer tank that establishes a head of primer water that is released by a flush valve to initiate syphoning followed by continued syphoning. In practice, the syphon tube flow activation is such as to require but a small quantity of water, a pint or two, discharged at the bottom opening of the discharge tube of the syphon. It is to be understood that operation of this flushing apparatus is dependent upon refilling of the water supply tank by a water level control, such as a float controlled water level valve or the like, so that the tank water returns to the bridge level of the syphon and subsequently refills the primer tank after each flushing operation.

The foregoing and various other objects and features of this invention will be apparent and fully understood from the following detailed description of the typical preferred forms and applications thereof, throughout which reference is made to the accompanying drawings.

THE DRAWINGS

Figure 2:
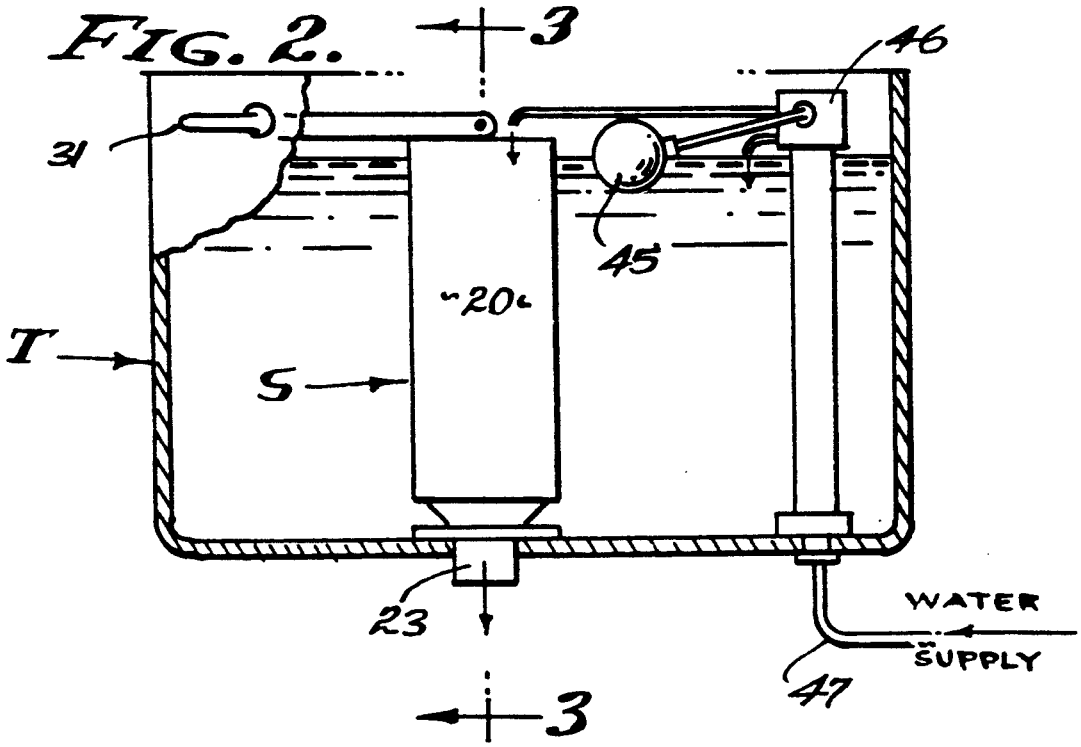
FIG. 2 is a sectional view taken as indicated by line 2—2 on FIG. 1, showing a passive ready condition.
Figure 4:
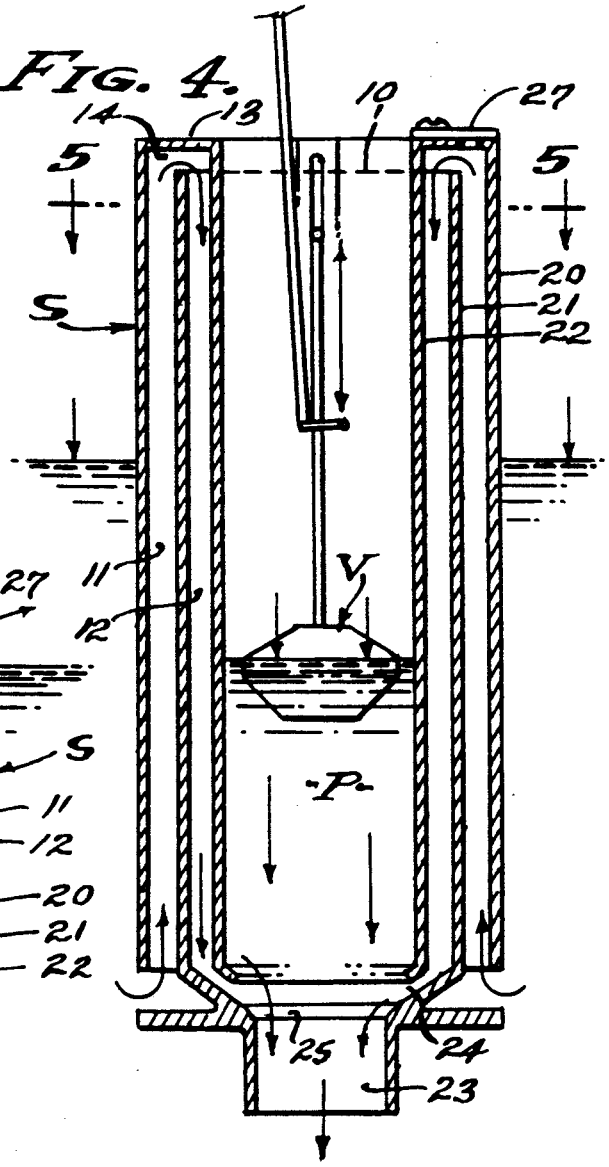
Figure 3:
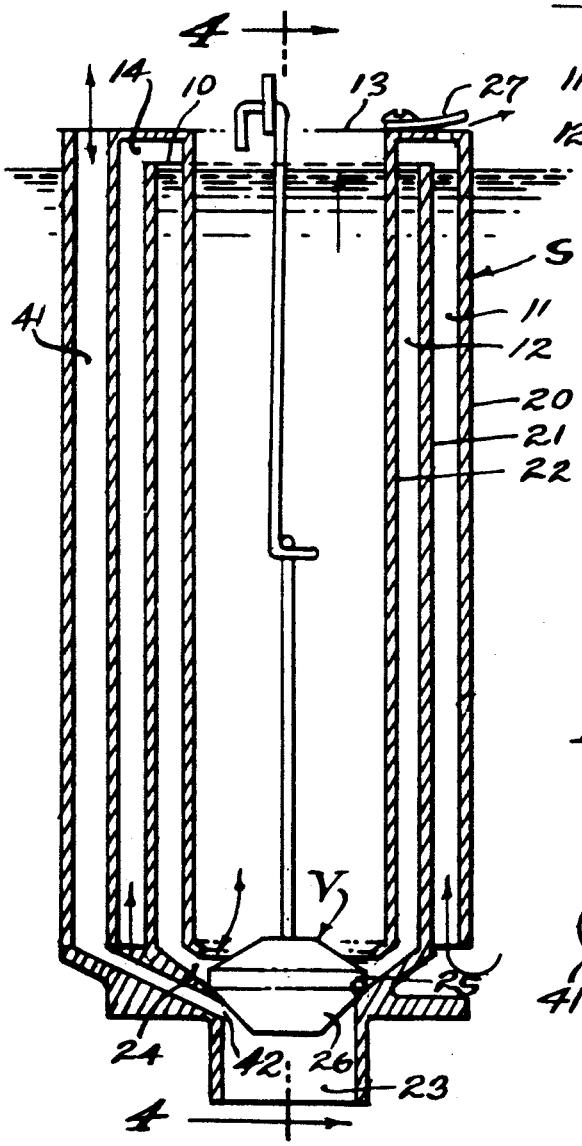
Figure 5:
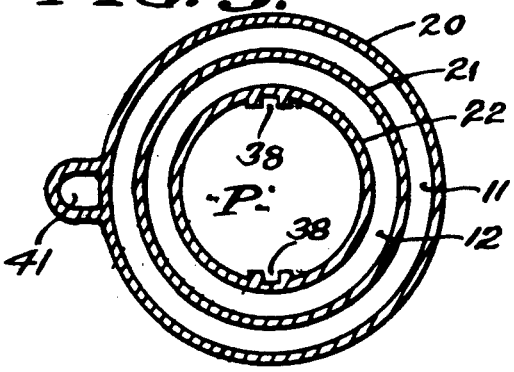

FIGS. 3 to 5 are enlarged sectional views, FIG. 3 being a vertical section taken as indicated by line 3—3 on FIG. 2, FIG. 4 being a vertical section showing the operated condition and taken as indicated by line 4—4 on FIG. 3, and FIG. 5 being a transverse section taken as indicated by line 5—5 on FIG. 4.

Figure 6:
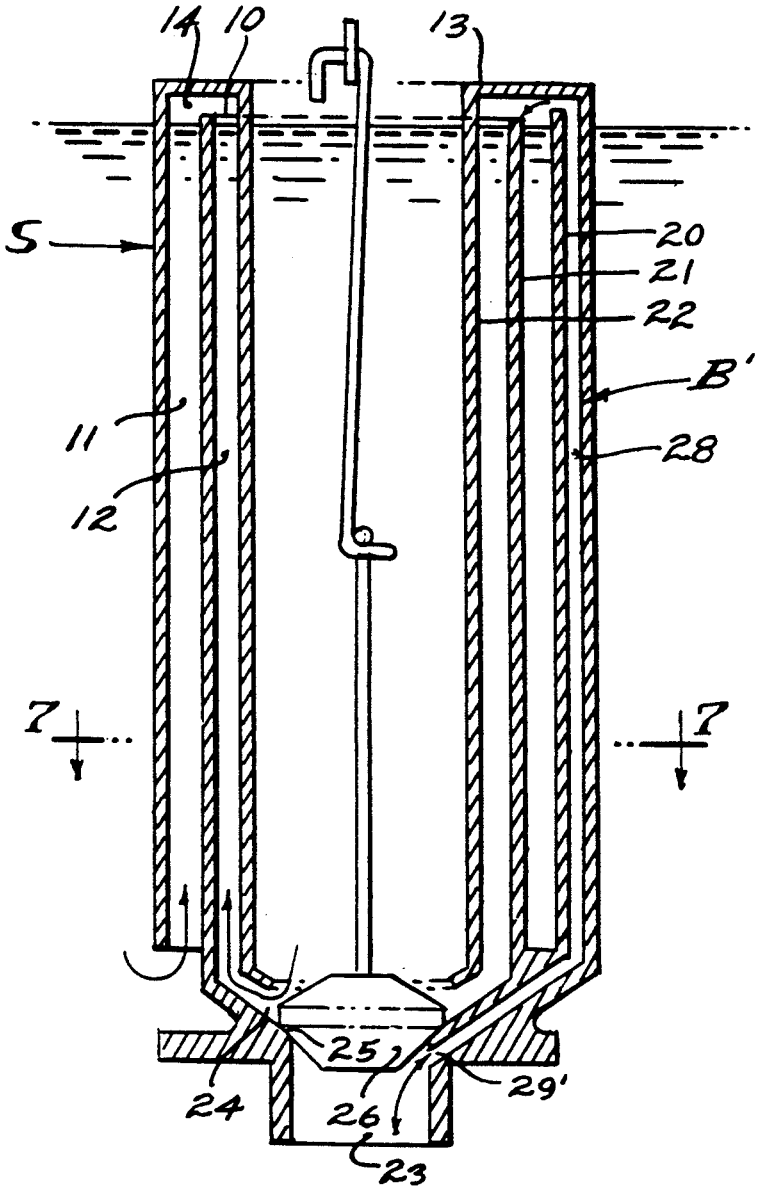
Figure 7:
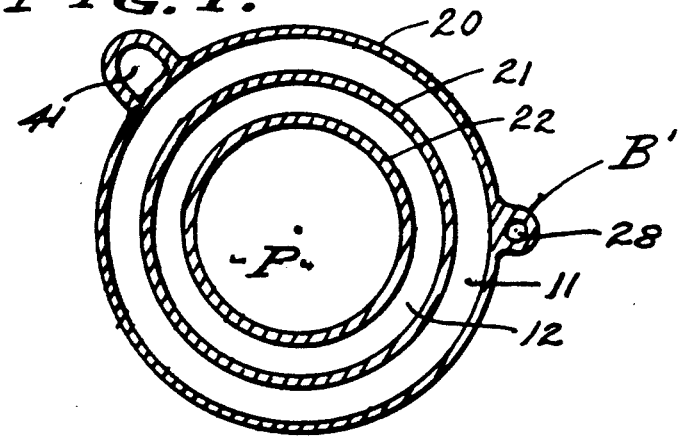

FIG. 6 is a vertical section similar to FIG. 3, showing a second form of controlled syphon breather; and FIG. 7 is a transverse section taken as indicated by line 7—7 on FIG. 6.

PREFERRED EMBODIMENT

Referring now to the drawings, the toilet and water supply tank T are conventional in every respect. And, the tank water level is controlled by a conventional float valve, so that the water supply level reaches a predetermined position just below a weir or bridge 10 of a syphon S within the supply tank. In accordance with this invention, there is the syphon S comprised of a suction leg 11 and a discharge leg 12, preferably concentric tubes 21 and 22 wherein the suction leg 11 is an annulus that surrounds the discharge leg 12 opening into a flush pipe 23. The suction leg opens from the bottom of the tank T and over the bridge 10 and into the top of the discharge leg 12 via a transfer passage 14, the suction leg 11 being filled with tank water to the bridge level.

Transfer passage 14 closes the top of the annuli between tubes 20, 21 and 22 forming a passage joining the two legs. A feature is the annular configuration of the discharge leg 12 and its inwardly turned foot or bottom jet opening 24 discharging circumferentially into the flush pipe 23 when the flush valve V is lifted. The suction leg 11 and discharge leg 12 are refilled after each flushing.

The toilet fixture is conventional, having a water supply tank T that is automatically filled with water by means of a float 45 controlled valve 46 from a water supply pipe 47. The water level in tank T is limited to a predetermined point just below the bridge 10 of the syphon S. The valve 46 discharges into the supply tank T and/or into the primer tank P in the usual manner, as is clearly shown in the drawings.

A feature herein disclosed is the syphon comprised of concentric tubes, wherein the suction leg 11 of the syphon surrounds the discharge leg 12 (see FIG. 5). The suction leg 11 opens from the bottom of the tank T and into the discharge leg 12 via the header transfer passage 14, the suction leg being filled with tank water to the bridge 10 level in the passive ready condition. Closely overlying the weir or bridge 10, there is an upper header 13, forming the closed transfer passage 14 at the joinder of the two legs, said passage being defined when the water level rises to a maximum at the bridge 10.

In accordance with this invention, the inner diameter wall of the discharge leg 12 is a tube 22 that forms a primer tank P at its top and closed by a flush valve V at its bottom and to the flush pipe 23. The flush valve V is a floatable ball valve or the like, passively seated at or within the jet opening 24. The circumferential jet opening 24 is slightly larger in diameter than the peripheral diameter of the flush valve V and substantially coincidental with the inside diameter of the flush pipe 23.

Referring now to the drawings, in the passive ready to flush condition, the apparatus provides wet legs 11 and 12, the flush valve being seated at the top of the flush pipe 23 and below the open bottom of the primer tank P and within and surrounded by the jet opening 24 (see FIG. 3). Accordingly, the inwardly turned discharge diameter of the jet opening 24 is greater in diameter than the peripheral diameter of the flush valve V, whereby the valve can be withdrawn upwardly therethrough so as to simultaneously open both the primer tank P and the jet opening 24 to the flush pipe 23 (see FIG. 4). The tube 22 is substantially greater in diameter than the flush valve V, so that there is free water flow over and around the valve V as and when it is lifted and initially permits rapid flow downwardly over the jet opening. After lifting the flush valve V to its height limit and upon its release, said floatable valve is permitted to float downward with the rush of water from the primer tank P, until it reaches the discharge of supply tank water discharging from the jet opening 24. A feature is that premature closure of the flush valve V is prevented by the flow of supply tank water from the jet opening 24, as next described.

The valve seat 25 is immediate to the inner diameter of the flush pipe 23 and is typically upwardly and outwardly inclined at an angle to interface with the engaging surface of the flush valve V that seats thereon. As shown, the sealing face 26 of the flush valve V is conical at the same angle as said seat 25, for example at 45°. In accordance with this invention, the jet opening 24 is downwardly and inwardly declined at a lesser angle than said face 26, for example at 35°. Therefore, the thrust of supply tank water discharged against the face 26 causes an upward reaction that supports the flush valve V until the flow of water subsides, whereupon the flush valve V drops onto the seat 25.

Refilling of the syphon requires a controlled exhaust to atmosphere from the legs 11 and 12 via the transfer passage 14, and to this end I provide a breather means B. This breather means B can vary in form and in the first embodiment (FIGS. 1-5) is shown as a flap valve 27 that checks air through a port 29 from outside atmosphere above the supply tank water level, while permitting the free exhaust of air as the legs 11 and 12 are being filled with water up to the bridge 10.

Figure 1:
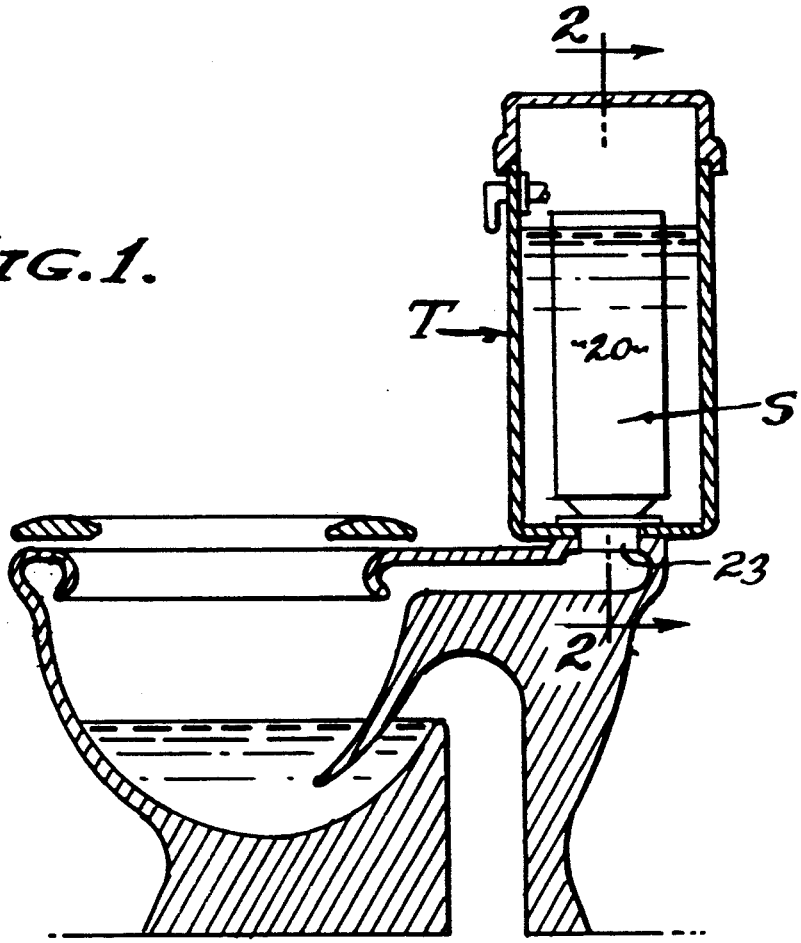
FIG. 1 is a cross sectional view of a toilet with the flushing apparatus of the present invention installed therein.

In a second and preferred embodiment (FIGS. 6 and 7) the breather means B' is comprised of a breather vent 28 from the transfer passage 14 and through a port 29' into the flush pipe 23 below the flush valve seat 25, so that there is open communication to atmosphere through the flush rim 30 of the toilet (see FIG. 1). The passive ready condition shown in FIG. 6 clearly illustrates this open vented communication, the two legs of the syphon being filled up to the bridge 10. As in the flush condition as shown in FIG. 4, primer tank water immediately covers and closes the vent port 29', so that it is occluded from the outside atmosphere, whereby the transfer chamber is instantaneously sealed in order to support the syphon effect. The port 29' remains closed to atmosphere until the supply tank water is completely discharged, and thereupon is opened for refilling the supply tank and primer tank to the passive ready condition. It will be observed that the required automation is achieved without moving parts, venting the transfer chamber 14 in the passive mode, and closing the port 29' to seal the transfer chamber in the flush mode, all of which is inherently operative. The float controlled filler valve 46 remains as a leakage factor, which could result in an overflow from tank T, providing that the flush valve V is effectively leakproof, and leakage of flush valve V disables the ready condition and requires refilling of the primer tank P and preferably repair of the valve V and/or its seat 25. Overflow as may be caused by a leaking filler valve 46 is diverted as waste water through the overflow standpipe 41 that opens from the top plane of header 13 above the bridge 10, and into the flush pipe 23 at 42 below the flush valve seat 25.

This flushing system features the absence of continuous water leakage by valves which have heretofore become defective. Only one small primer tankful of water can be lost through malfunction of the flush valve V. This renders this system superior with respect to the relatively large volume of water stored in the supply tank ready for flushing and which continuously leaks as waste water in conventional non-syphon toilets. Water is inherently conserved when practicing this invention.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A primer activated syphon flusher for toilets having a flush tank and a flush pipe opening into a toilet bowl, and having a water level control means responsive to depletion of water in said tank to refill said tank to a predetermined water level, and including;

a syphon within the flush tank and comprised of a suction leg opening within the bottom of said tank and extending upward to a bridge at the aforesaid predetermined water level, and a discharge leg continuing from the suction leg and extending downward from the bridge and discharging through a jet opening and into the flush pipe, a closed header spaced above the bridge to define a transfer passage connecting the suction leg and discharge leg of the syphon, there being a breather means opening from the transfer passage to check air flow from outside atmosphere while permitting free exhaust of air for refilling the two legs of the syphon, a primer tank passively closed by a flush valve seated on said flush pipe below said jet opening and refilled by said water level control means to a water level coincidental with said predetermined water level said primer tank having a discharge at said jet opening and into the flush pipe, means for opening the flush valve to initiate syphoning by discharge of primer tank water over the jet opening for inducing a suction effect causing suction leg water to rise over the bridge and into the discharge leg and from said jet opening into the flush pipe, and continuing until the flush tank water level is depleted, wherein said breather means comprises a conduit extending from said transfer passage exterior of said suction leg and connected to said flush pipe below said flush value.

2. The primer activated syphon flusher for toilets as set forth in claim 1, wherein the suction leg and discharge leg of the syphon are formed of concentric tubes.

3. The primer activated syphon flusher for toilets as set forth in claim 1, wherein the discharge leg of the syphon is separated from the primer tank by a tubular wall.

4. The primer activated syphon flusher for toilets as set forth in claim 1, wherein the discharge leg of the syphon surrounds a tubular wall of the primer tank and at the bottom of which tubular wall the jet opening discharges annularly into the flush pipe.

5. The primer activated syphon flusher for toilets as set forth in claim 1, wherein the suction leg, discharge leg and primer tank are formed of concentric tubes, the discharge leg of the syphon and the primer tank sharing a common tubular wall at the bottom of which the jet opening discharges annularly and into the flush pipe.

6. The primer activated syphon flusher for toilets as set forth in claim 1, wherein the flush valve closes passively upon a seat at the upper end of the flush pipe and below the jet opening and discharge of the primer tank, whereby the discharge leg and primer tank refill to said predetermined water level.

7. The primer activated syphon flusher for toilets as set forth in claim 1, wherein the discharge leg of the syphon surrounds a tubular wall of the primer tank and at the bottom of which tubular wall the jet opening discharges annularly into the flush pipe, and wherein the flush valve closes passively upon a seat at the upper end of the flush pipe and below the jet opening and below the discharge of the primer tank.

8. The primer activated syphon flusher for toilets as set forth in claim 1, wherein the suction leg, discharge leg and primer tank are formed of concentric tubes, the discharge leg of the syphon and the primer tank sharing a common tubular wall at the bottom of which the jet opening discharges annularly and into the flush pipe, and wherein the flush valve closes passively upon a seat at the upper end of the flush pipe and below the jet opening and below the discharge of the primer tank.

9. The primer activated syphon flusher for toilets as set forth in claim 1, wherein the flush valve is a floatable element to float upon primer tank water and the rush of flush tank water from the jet opening.

10. The primer activated syphon flusher for toilets as set forth in claim 1, wherein the flush valve is floatable and closes passively upon a seat at the upper end of the flush pipe and below the jet opening and discharge of the primer tank, the bottom seating face of the flush valve being upwardly and outwardly inclined to interface with the seat and the jet opening being downwardly and inwardly declined at a lesser angle than said seating face of the flush valve, whereby supply tank water discharged against the bottom seating face of the flush valve causes an upward reaction to prevent its premature seating.

11. The primer activated syphon flusher for toilets as set forth in claim 1, wherein the flush valve is floatable, and wherein the means for opening the flush valve is comprised of a manually operable lever engaged with the flush valve to lift it to a floating position on the primer tank water.

12. A primer activated wet discharge syphon flusher for toilets having a flush tank and a flush pipe opening into a toilet bowl, and having a water level control means responsive to depletion of water in said tank to refill said tank to a predetermined water level, and including;

a syphon within the flush tank and comprised of inner and outer tubes and an intermediate tube defining a suction leg opening within the bottom of said tank and extending upward to a bridge at the aforesaid predetermined water level, and a discharge leg continuing from the suction leg and extending downward from the bridge and discharging downwardly and inwardly through an annular jet opening and into the flush pipe, a closed header extending between said inner and outer tubes and spaced above the bridge to define a transfer passage connecting a wet suction leg and a wet discharge leg of the syphon, there being a breather means comprised of a vent opening above the syphon bridge and from the transfer passage to a port immediately below the flush valve seat and into the flush pipe and open to outside atmosphere via the toilet bowl in the passive ready to flush mode, and closed by primer tank water in the flush mode by occluding said port from outside atmosphere and thereby enabling the syphon effect, a primer tank defined by and within the inner tube and having an open bottom discharge at said jet opening, a top of the flush pipe being passively closed by a floatable flush valve engageable on a seat disposed below the jet opening, and the primer tank being refilled by said water level control means to a water level coincidental with said predetermined water level and to discharge at said jet opening and into the flush pipe when the flush valve is opened, and means for opening the floatable flush valve to initiate syphoning by discharge of primer tank water over the jet opening and inducing a suction effect causing wet suction leg water to rise over the bridge and into the water within the wet discharge leg water and from said jet opening and through said seat and into the flush pipe, and continuing until the flush tank water level is depleted.

* * * * *